US006394705B1

(12) United States Patent
Lefebvre

(10) Patent No.: US 6,394,705 B1
(45) Date of Patent: May 28, 2002

(54) MODULAR FLOOD CONTAINMENT STRUCTURE

(76) Inventor: Gaétan Lefebvre, 228 Valcartier Blvd, Loretteville, Quebec (CA), G2A 2M7

( * ) Notice: Subject to any disclaimer, the term of this patent is extended or adjusted under 35 U.S.C. 154(b) by 0 days.

(21) Appl. No.: 09/481,474

(22) Filed: Jan. 11, 2000

(51) Int. Cl.[7] ..... E04B 2/02; E04C 1/00; B66C 1/66

(52) U.S. Cl. ..... 405/262; 405/284; 52/604; 52/569; 52/592.1

(58) Field of Search ..... 405/284–287, 405/262, 258, 272; 446/128, 125, 124, 122, 116, 104; 52/604, 608, 561, 569, 570, 125.4, 125.5, 592.1, 592.4–592.6; 47/66.1, 66.5, 66.2–66.4

(56) References Cited

U.S. PATENT DOCUMENTS 2,826,906 A * 3/1958 Rice
3,030,093 A * 4/1962 Reintjes
3,618,279 A * 11/1971 Sease ..... 52/227
4,107,894 A * 8/1978 Mullins ..... 52/593
4,297,816 A * 11/1981 Kella et al. ..... 52/125
4,436,447 A * 3/1984 Crowe ..... 405/16
4,573,301 A * 3/1986 Wilkinson ..... 52/607
4,650,368 A * 3/1987 Bayer ..... 405/111
4,740,189 A * 4/1988 Bertrand ..... 446/128
4,799,821 A * 1/1989 Brodersen ..... 405/115
4,965,979 A * 10/1990 Larrivee et al. ..... 405/284 X
5,040,919 A * 8/1991 Hendrix ..... 405/415
5,421,135 A * 6/1995 Stevens et al. ..... 52/604
5,537,796 A * 7/1996 Kliethermes, Jr. ..... 52/592.6
5,651,642 A * 7/1997 Kelley, Jr. et al. ..... 405/286
6,088,987 A * 7/2000 Simmons et al. ..... 405/285 X

* cited by examiner

*Primary Examiner*—Christopher J. Novosad
(74) *Attorney, Agent, or Firm*—Eric Fincham

(57) ABSTRACT

A modular block and a retaining wall filled of the modular blocks, each modular block having a body portion with first and second opposed ends, an interior hollow portion to receive a ballast, the first one of the opposed ends having a plurality of tenons extending outwardly therefrom, a second one of the opposed ends having a plurality of mortices formed therein, the arrangement being such that the modular block be connected to an adjacent modular block at varying angles by means of the mortices and tenons. The retaining wall may conveniently be used as a flood containment structure.

12 Claims, 5 Drawing Sheets

MODULAR FLOOD CONTAINMENT STRUCTURE

FIELD OF THE INVENTION

The present invention relates to a retaining wall such as may be used as a flood containment structure and in particular, is related to a modular block for forming such a retaining wall.

BACKGROUND OF THE INVENTION

The problem of trying to contain flooding has been addressed in the prior art. Typically, in the case of flooding caused by the overflow of rivers and the like, walls of sand bags are placed in strategic places to either divert or hold back the flood water. In the case of hazardous liquid spills, the fire department usually relies on local material to fill sand bags for containment of the liquid spill.

Unpredictable environmental conditions and development of civilization have led to increase in terrains subject to flooding. High yield cropland, residential and commercial structures, roadways, railroads and virtually all forms of civilian development located adjacent bodies of waters such as rivers, lakes, oceans and the like are susceptible to flooding potentially causing enormous material damage and also potentially causing life-threatening situations.

Some areas particularly prone to flooding are usually at least partially protected by permanent earth dikes or levees. However, in certain circumstances, such dikes or levees may prove to be inadequate and subsequently breached, causing flooding and the above mentioned results.

The development of efficient communication methods as well as weather monitoring techniques has led to an increased number of situations wherein flooding of particular areas may be anticipated with relative accuracy. In such situations, it is typical to attempt to protect such areas by using sand bag barriers or temporary earthen levees or dikes.

In situations wherein permanent levees or dikes are already in place and are being topped by the rising flood waters, wooden planks, sand bags or temporary earth fills are typically used to increase the height of such levees. Although somewhat useful, the use of prior art structures such as sand bags for temporarily providing flood protection has proven to be unsatisfactory.

Indeed, the erection of sand banks and earth filled barriers are labor and equipment intensive. Furthermore, they are time-consuming especially when considering that the time available to provide at least temporary flood protection in the flood prone areas may range from hours to several days. Also, such prior art structures can rapidly become saturated and structurally weakened to the point of failure. Furthermore, they create a problem with respect to their removal after the flood waters have subsided.

There have been proposals in the art to address some of the aforementioned problems. Thus, as shown in U.S. Pat. No. 4,650,368, there is provided a water permeable bag of coarse absorbing material which is used in place of the sand bags. Being lighter than the sand bags, they are easier to place. However, one can envision practical problems with drying, storage and disposal of the bags.

It has also been proposed in the art to provide a bag filled with water instead of sand. However, typically such devices include many different types of valves, special shapes and the like and as a result, they have not received any degree of acceptance.

U.S. Pat. No. 4,799,821 teaches a plastic tube which may assume an oval shape when filled with water. The tube is tied in a knot at each end to keep water in. As will be really understood, to tie a knot in a relatively large tube would not necessarily be an effective way of sealing such a device.

A still further proposal is set forward in U.S. Pat. No. 5,040,919 wherein a triangularly shaped member is provided and which is filled with water. However, it would appear that the devices would have to be manufactured in a substantial length and means of interconnecting the devices are not discussed.

SUMMARY OF THE INVENTION

It is therefore an object of the present invention to provide an improved retaining wall formed of a plurality of modular blocks.

It is a further object of the present invention to provide a modular block which may be used as a retaining wall and in particular as a flood control barrier which is easily transportable and deployable.

It is a further object of the present invention to provide a modular block for use into sorting a retaining wall suitable for use as a flood control barrier wherein the modular block may be easily manufactured through the use of conventional and relatively inexpensive manufacturing techniques and which modular block allows it to be stored using a relatively small storage space.

According to one aspect of the present invention, there is provided a modular block suitable for building a retaining wall, the modular block comprising a body portion having first and second opposed ends, the body portion having a hollow portion designed to receive ballast, a first one of the opposed ends having a plurality of tenons extending outwardly therefrom, a second end of the opposed ends having a plurality of mortices formed therein, the arrangement being such that the modular block can be connected to an adjacent modular block at varying angles by means of the mortices and the tenons.

According to a further aspect of the present invention there is provided a retaining wall formed of a plurality of modular blocks, the improvement wherein each of the modular blocks comprises a body portion having first and second opposed ends, the body portion having a hollow portion with a ballast therein, a first one of the opposed ends having a plurality of tenons extending outwardly therefrom, a second end of the opposed ends having a plurality of mortices formed thereat, the modular blocks being arranged end to end such that a first modular block is connected to an adjacent modular block by interconnection of the tenons with the mortices, the modular wall having varying angles.

The modular block of the present invention has first and second opposed ends, each end carrying a complementary interconnecting structure. The interconnecting structure is such that the modular blocks may be connected at various angles so as to provide maximum flexibility in the design of the retaining wall. Furthermore, the blocks are designed so that they do not necessarily need to be on a planar surface—i.e. they are capable of being arranged in a step like manner.

In a preferred embodiment, the interconnecting structure is that of a tenon and mortice arrangement—i.e. one of the ends has projecting tenons which are sized to fit within corresponding mortices at an opposite end of an adjacent block. In one particularly preferred form of the modular block, a first end has an overall semispherical projecting portion with a convex outer wall having mortices formed therein while at the other end, there is provided a concave end wall of a generally semispherical configuration with tenons projecting outwardly from the concave end wall. Other similar configurations can be used for interconnecting the end walls.

The modular block may be formed as a single unit by suitable means such as injection molding. Alternatively, the unit may be arranged to have an insert, which insert would generally follow the contour of the modular block configuration. The insert may be formed of a similar or dissimilar material and in one embodiment, may be designed to be resistant to any fluid material used as ballast. The insert could also, for example, add ballast weight. In one embodiment, the insert may be designed to have tapered walls as to be stackable while the outer shell of the modular block will provide for the interlocking arrangement.

Preferably, the outer block includes means for easy transport thereof and to this end, there may be provided suitable handles. As will be appreciated, many different types of handles may be employed including, in the preferred embodiments, recessed handles formed in side walls of the modular block.

The modular block of the present invention is designed to be stackable and to this end, there are provided means for interconnecting the blocks in a vertical arrangement and for securing the blocks in the desired position.

The modular block will have inlet and outlet means for filling the interior thereof with a suitable ballast and which ballast may include any suitable material including known materials such as water and sand.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
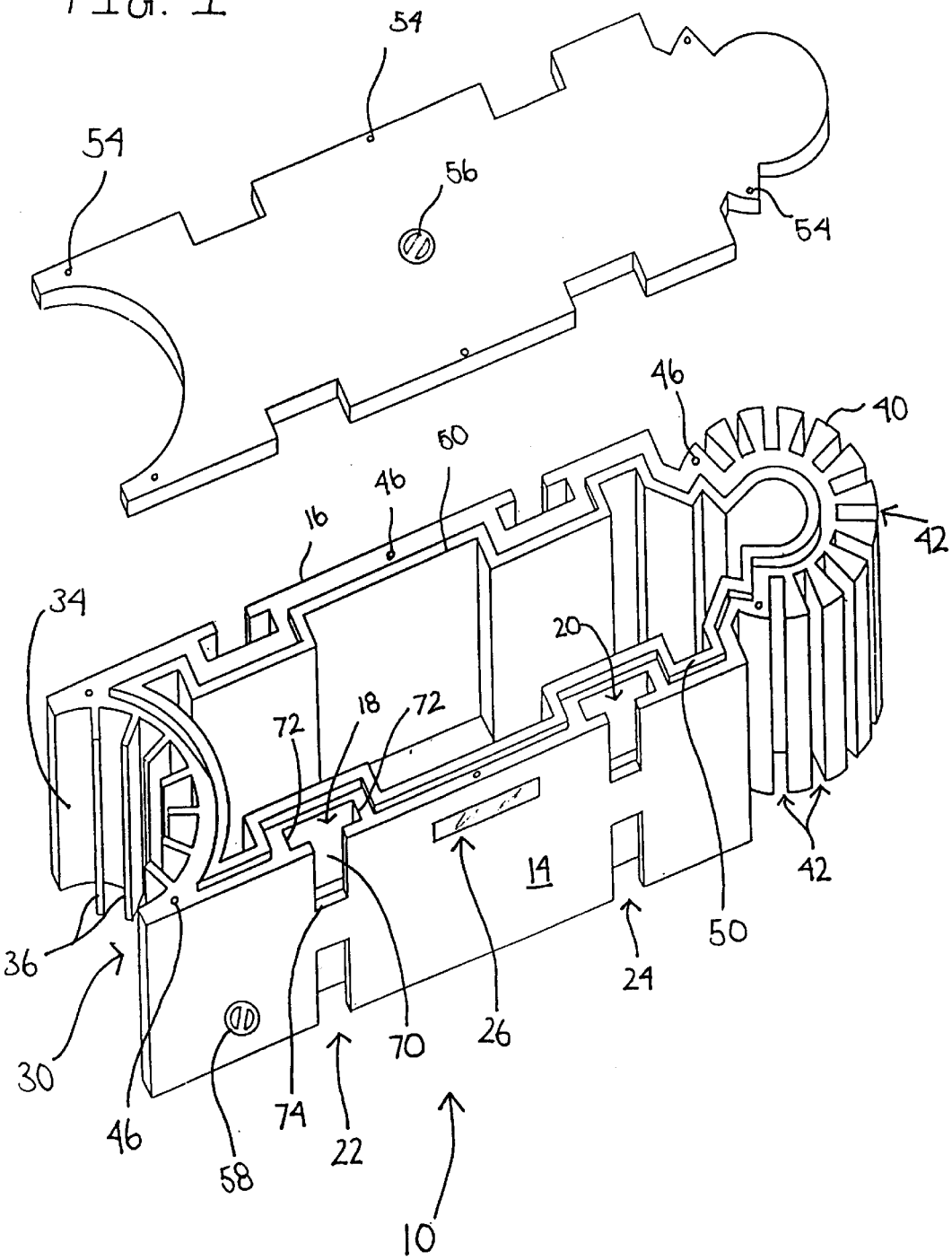
FIG. 1 is a perspective exploded view illustrating a modular block according to the present invention with the cover portion removed.

Referring to the drawings in greater detail and by reference characters thereto, there is illustrated a modular block which comprises a block body generally designated by reference numeral 10 and a cover member generally designated by reference numeral 12.

Figure 2:
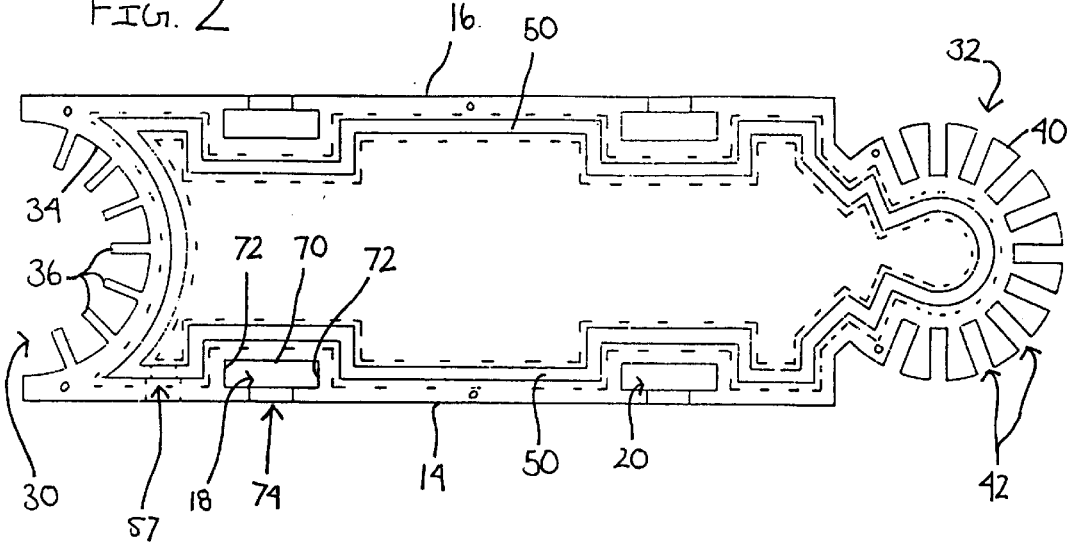
FIG. 2 is a top plan view of the modular block of FIG. 1 with the cover removed.
Figure 3:
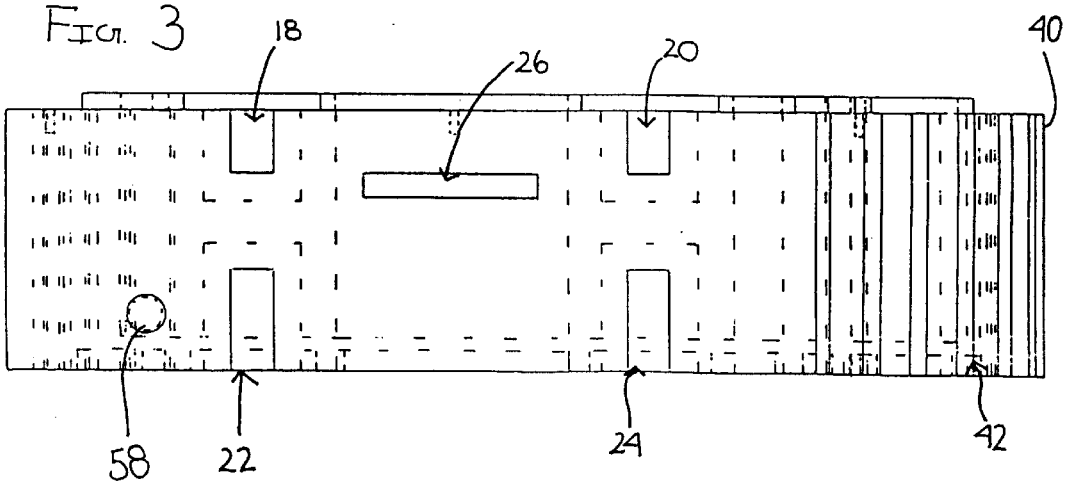
FIG. 3 is a side elevational view of the modular block of FIG. 1.
Figure 4:
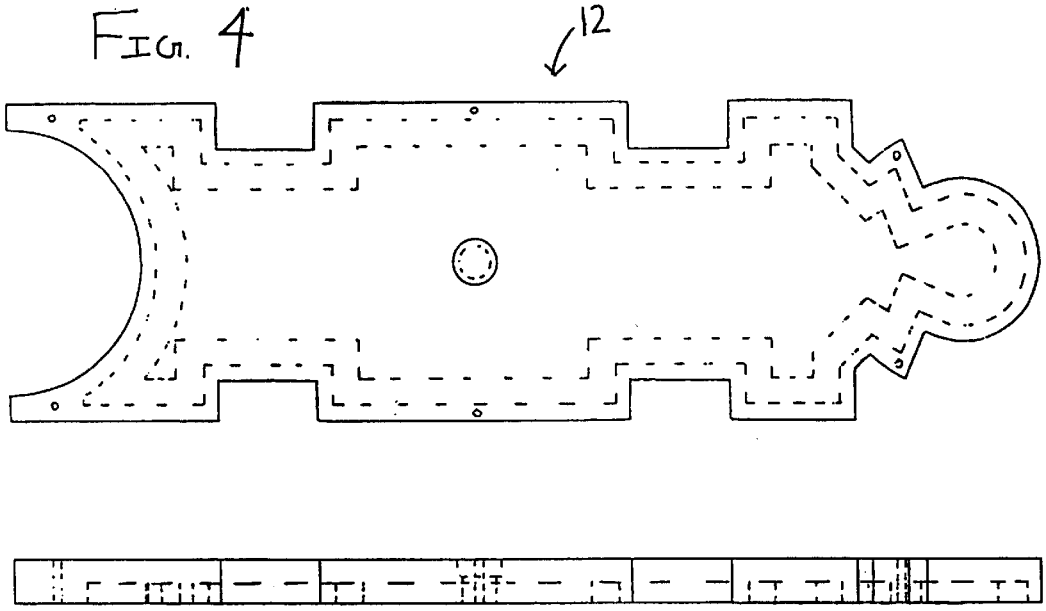
FIG. 4 is a top plan view of the cover member of FIG. 1.
Figure 4:
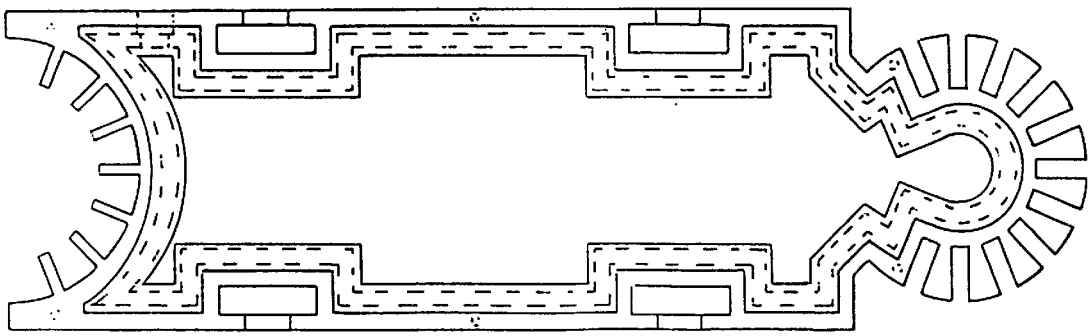

Block body 10 includes a pair of opposed side walls 14 and 16. Each side wall is substantially similar and thus only one will be described herein. As may best be seen in FIGS. 1, 2 and 3, side wall 14 has a pair of upper recesses 18 and 20 formed therein and a pair of lower recesses 22 and 24. As seen in FIG. 2, recess 18 is defined by a back wall 70 and a pair of side walls 72 with a slot 74 communicating with the recess. It will be noted that slot 74 is narrower than the back wall 70 and has a lesser depth or height.

Handle means are provided in side walls 14 and 16 by means of a handle recess 26.

Modular block body 10 includes a first end generally designated by reference numeral 30 and a second end generally designated by reference numeral 32 and which will now be described in greater detail.

First end 30 is generally defined by a concave end wall 34 which is of a semispherical outline. Extending outwardly from concave end wall 34 are a plurality of radiating tenons 36.

Second end 32 has a convex end wall 40 with a plurality of mortices 42 formed therein. As will be readily understood, the arrangement is such that tenons 36 are designed to fit within mortices 42 of an adjacent block.

Block body 10, in the illustrated embodiments, includes a liner 50 which has a configuration substantially identical to block body 10 and is designed to fit interiorly thereof.

Formed in the upper marginal edge of side walls 14 and 16 are a plurality of apertures 46. As may be seen in FIGS. 1 and 3, cover member 12 is designed to fit on the top of block body 10 and may be secured thereto by means of apertures 54 which are in alignment with apertures 46 of side walls 14 and 16. Any suitable means of securing the cover may be used; a system of pegs and apertures could be utilized if so desired.

To provide access to the interior cavity of block body 10, there is provided an opening in cover 12 which is sealed by plug 56 while in the lower portion of side wall 14, there is provided a drainage plug 58 sealing a drainage aperture 57 (FIG. 2).

Figure 5:
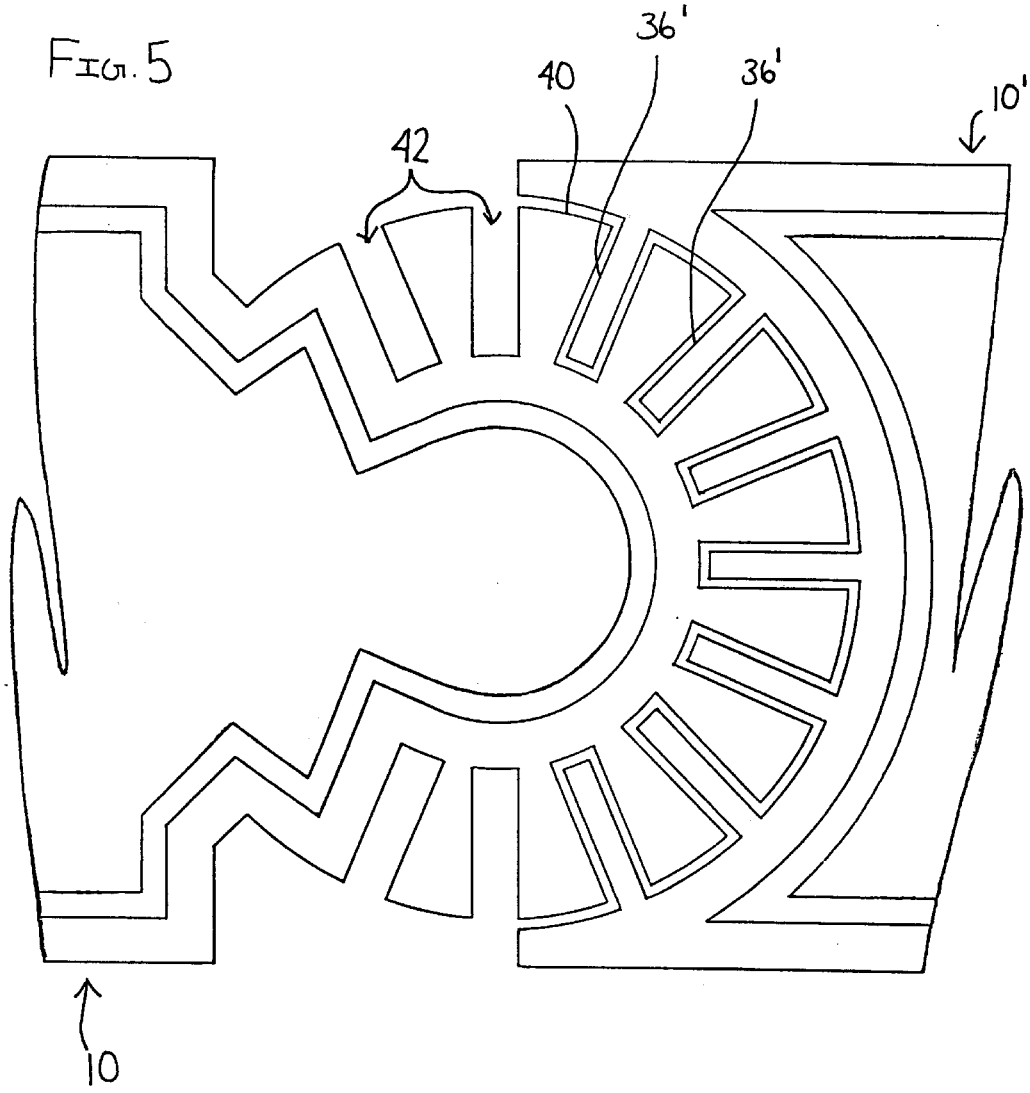
FIG. 5 is a detailed view showing the interlocking arrangement between adjacent blocks of a wall.
Figure 6:
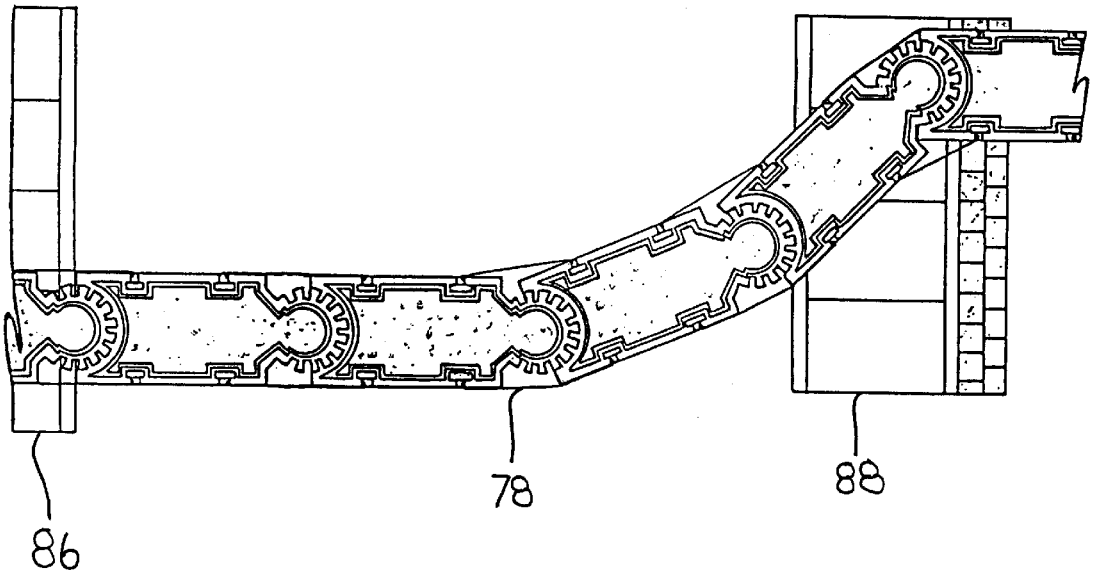
FIG. 6 is a top plan view of a wall constructed of a plurality of modular blocks.
Figure 7:
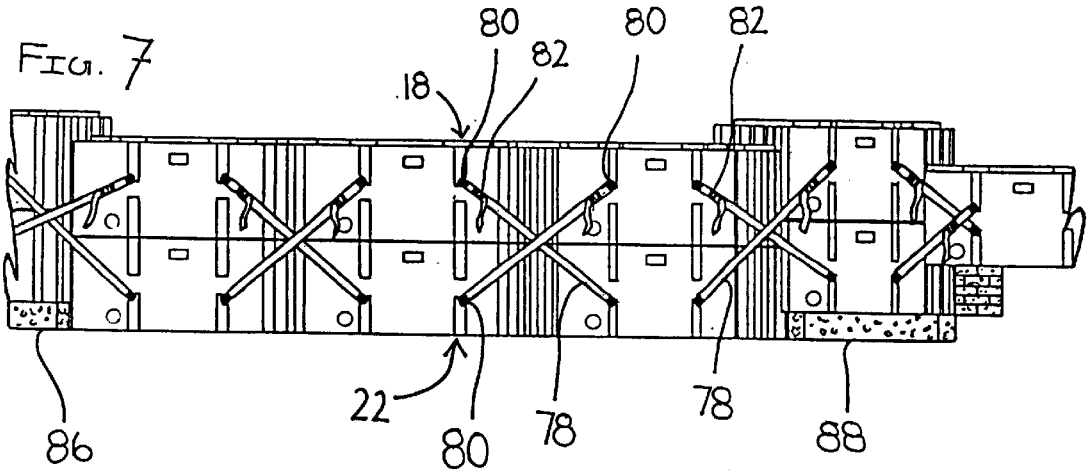
FIG. 7 is a side elevational view of the wall of FIG. 6.

A wall structure utilizing the modular blocks of the present invention is illustrated in FIGS. 5, 6 and 7. As shown in FIG. 5, tenons 36' of an adjacent modular block 10' are arranged to fit within mortices 42 of block 10. It will be noted that there are fewer tenons 36 than mortices 42 to thus enable the blocks to be angled with respect to each other. Thus, as seen in FIG. 6, various angles can be achieved with the interconnection system of the present invention.

Also as shown in FIGS. 6 and 7, when required to pass over raised portions 86 and 88, the blocks of the present invention may still be utilized.

To provide stability to the structure, securing straps 78 are provided; securing straps 78 include end fittings 80 sized to fit within and be retained by recesses 18, 20, 22 and 24. An adjustment buckle 82 is provided on each securing strap 78 to adjust the tension and ensure distribution of the forces acting on the wall.

Thus, as may be seen from the above, there is provided a retaining wall formed of a plurality of modular blocks and which is easily assembled and yet provides a secure structure with all members interlocked. The joints between the various members may be provided with appropriate means for sealing the same—i.e. the use of strips of polymeric material and/or other similar types of weatherstripping material may be employed. Furthermore, the provision of the recesses 18, 20, 22 and 24 will allow for various types of interconnection and if desired, a complete cover could be placed over the side using these recesses with appropriate fittings to seat therein.

It will be understood that the above described embodiment is for purposes of illustration only and that changes or modifications may be made thereto without departing from the spirit and scope of the invention.

I claim:

1. A modular block suitable for building a retaining wall, said modular block comprising:

a body portion having first and second opposed ends;

said body portion having a hollow portion designed to receive ballast;

a first one of said opposed ends having a first end wall of a concave configuration, a plurality of tenons extending outwardly from said concave end wall;

a second one of said opposed ends having a second end wall of a convex configuration, a plurality of mortices formed in said second end wall;

a liner within said hollow portion, said liner being configured to fit within said hollow portion; the arrangement being such that said modular block can be connected to an adjacent modular block at varying angles by means of said mortices and said tenons.

2. The modular block of claim 1 wherein said concave end wall and said convex end wall each are semispherical in configuration.

3. The modular block of claim 1 wherein the number of said mortices exceeds the number of said tenons.

4. The modular block of claim 1 wherein said modular block has a rectangular configuration, and includes a removeable cover member forming a top wall of said block.

5. The modular block of claim 4 further including fluid inlet means providing access to said hollow portion to thereby permit the loading of said hollow portion with a ballast.

6. The modular block of claim 1 wherein said modular block includes a pair of opposed side walls, each of said side walls having handle means formed therein.

7. The modular block of claim 1 wherein said modular block has a pair of opposed side walls, and further including vertically extending recesses formed in each of said side walls.

8. A modular block suitable for building a retaining wall, said modular block comprising:

a body portion having opposed ends;

said body portion having a hollow portion designed to receive ballast;

a first one of said opposed ends having a first end wall of a generally concave configuration, a plurality of tenons radiating outwardly from said concave first end wall; and a second one of said opposed ends having a second end wall of a generally convex configuration, said convex second end wall having a plurality of mortices formed therein, said mortices extending inwardly from said convex second end wall.

9. The modular block of claim 8 wherein the number of said mortices exceeds the number of said tenons.

10. The modular block of claim 8 wherein said modular block has a rectangular configuration and includes a removable cover member forming a top wall of said modular block.

11. A modular block suitable for building a retaining wall, said modular block comprising:

a body portion having opposed ends;

said body portion having a hollow portion designed to receive ballast;

a first one of said opposed ends having a plurality of tenons extending outwardly therefrom;

a second one of said opposed ends having a plurality of mortices formed therein;

said body portion including first and second opposed side walls, at least one vertically extending recess formed in each of said side walls, said recesses extending the height of each of their respective side walls; and first and second discrete slots associated with each recess and being formed in a respective side wall, each of said first and second slots having a width less than the width of the respective recess.

12. The modular block of claim 11 wherein said first one of said opposed ends has a first end wall of a concave configuration, said plurality of tenons radiating outwardly from said concave end wall, said second one of said opposed ends having a second end wall of a convex configuration, said mortices extending inwardly from said convex end wall.

* * * * *